US007686922B2

(12) United States Patent
Bauböck et al.

(10) Patent No.: US 7,686,922 B2
(45) Date of Patent: Mar. 30, 2010

(54) PROCESS AND DEVICE FOR DEWATERING A FIBER WEB

(75) Inventors: Jörg Bauböck, Graz (AT); Paul Arnold, Liverdun (FR)

(73) Assignee: Andritz AG, Graz (AT)

( * ) Notice: Subject to any disclaimer, the term of this patent is extended or adjusted under 35 U.S.C. 154(b) by 458 days.

(21) Appl. No.: 11/649,601

(22) Filed: Jan. 4, 2007

(65) Prior Publication Data

US 2007/0181276 A1 Aug. 9, 2007

(30) Foreign Application Priority Data

Jan. 5, 2006 (AT) ..... A 14/2006

(51) Int. Cl.
*D21F 1/48* (2006.01)

(52) U.S. Cl. ..... 162/217; 162/208; 162/363

(58) Field of Classification Search ..... 162/217, 162/208, 363, 370

See application file for complete search history.

(56) References Cited

U.S. PATENT DOCUMENTS 2,991,218 A * 7/1961 Cirrito et al. ..... 162/217
5,935,382 A * 8/1999 Huovila et al. ..... 162/123

* cited by examiner

*Primary Examiner*—Mark Halpern
(74) *Attorney, Agent, or Firm*—Alix, Yale & Ristas, LLP

(57) ABSTRACT

A process and a device for dewatering a fiber web 3, especially a paper web, using vacuum. The vacuum seen by a given unit are of the web is pulsed between a maximum value V and a minimum value. At least one suction box 7 is provided with perforations beneath the running web where the vacuum is applied with a pulsating effect on the web.

13 Claims, 3 Drawing Sheets

PROCESS AND DEVICE FOR DEWATERING A FIBER WEB

BACKGROUND

The invention concerns a process and a device for dewatering a fiber web, especially paper web, using vacuum.

In known processes, dewatering of, e.g., a paper web on an air-permeable wire or felt takes place after the forming zone with vacuum that extracts water from the web and the wire or felt through boxes located under the web and the wire. Vacuum dewatering is used particularly in tissue machines working according to the through drying principle. The water is normally extracted through slots in a plate over which the paper web passes. The goal of the dewatering is to achieve as high a dryness of the paper web as possible after application of the vacuum. However, the achievable dryness is limited by the intensity of the vacuum and the slot width.

SUMMARY

The goal of the invention is, therefore, to increase the dryness after vacuum dewatering by a few percentage points in comparison with conventional dewatering or to maintain the dryness and achieve energy savings at the vacuum pumps.

The disclosure is characterized by the vacuum applied to each unit of the web, pulsating between a maximum and a minimum value, preferably with the maximum value of the vacuum being between 150 and 900 mbar, most preferably between 300 and 700 mbar. With this pulsating application of the vacuum, dewatering can be greatly improved in comparison with conventional constant application.

An advantageous embodiment is characterized by 3 to 100 pulses, preferably between 25 and 100 pulses, being applied to a particle of the moving paper web. Improved dewatering performance is obtained by a higher number of pulses.

An advantageous further embodiment is characterized by the minimum value of the vacuum being 0 mbar.

To push the dewatering performance further, it is advantageous to use two or more vacuum sources successively for dewatering the fiber web, especially paper web.

A pulsation frequency of between 1,500 and 10,000 Hertz has proved particularly advantageous for the dewatering performance.

The disclosure is also directed to a device for dewatering a fiber web, especially a paper web, using vacuum. It is characterized by at least one suction box being provided, at which a vacuum is pulsating between a maximum and a minimum value, with the—at least one—suction box having a perforated plate at the side facing the fiber, especially paper, web. With such a suction box connected to a vacuum plant, essentially higher dryness values can be achieved than with conventional plants.

An advantageous embodiment is characterized by the holes of the perforated plate being circular, oblong or elliptic. High free areas can be obtained in this manner.

An advantageous further embodiment is characterized by the holes of the perforated plate having a distance (between centres) of 4 to 25 mm viewed in the direction of the web run, with the holes in successive rows of holes crosswise to the direction of the web run possibly overlapping. With such a pitch, an optimum number of pulses can be realised.

If the—at least one—suction box has a length of 100 to 500 mm, preferably 200 to 400 mm, viewed in the direction of the web run, a sufficient number of pulses and, therefore, high dewatering performance can be realised.

It is especially advantageous to have several, especially two, suction boxes arranged successively at the fiber web, especially paper web, in the direction of the web run.

BRIEF DESCRIPTION OF THE DRAWING

The preferred embodiments of the invention are described below in examples and with reference to the drawing, where.

DETAILED DESCRIPTION

Figure 1:
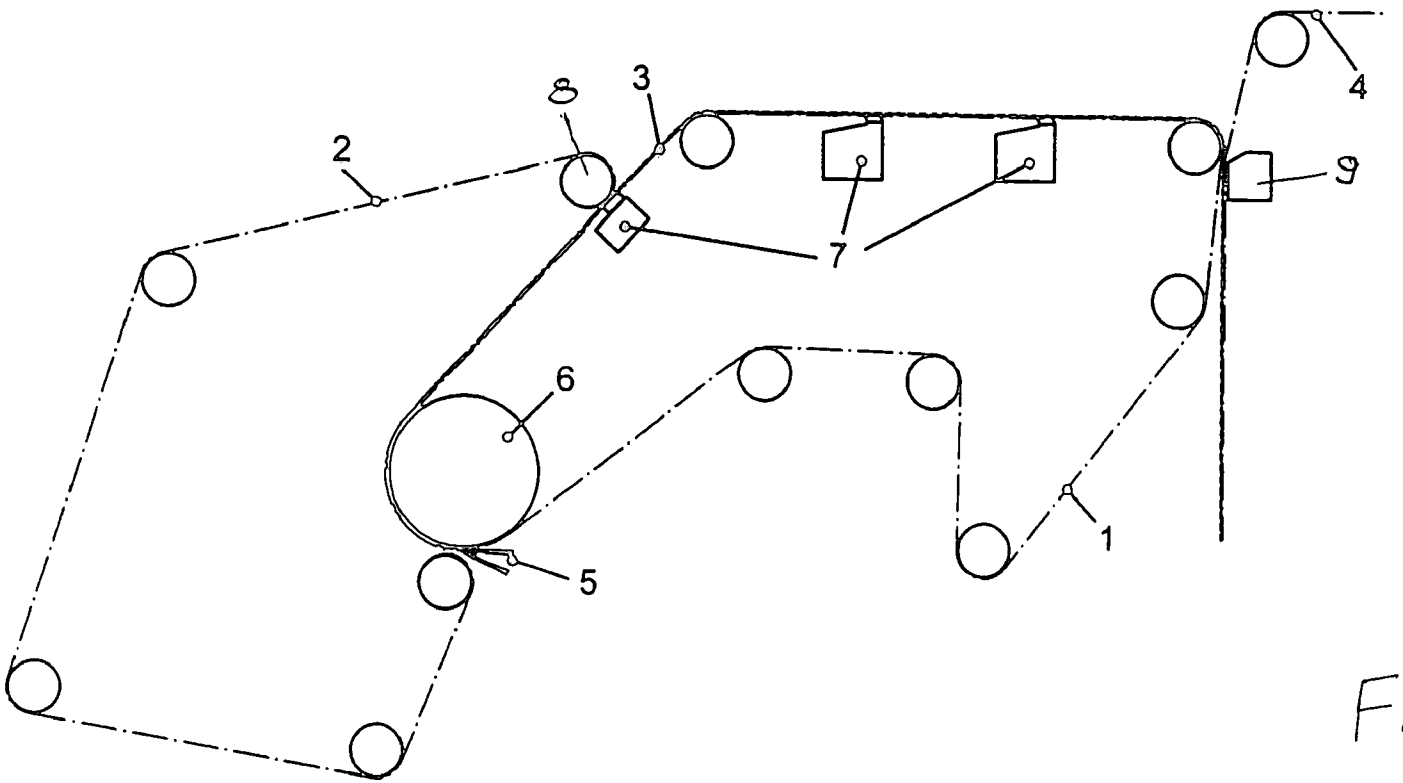
FIG. 1 shows an arrangement on a forming wire of a through drying machine according to an aspect of the invention.

FIG. 1 shows the wet section of a paper machine, particularly of a through drying plant, in a tissue machine. This section is designed for sheet formation and comprises a forming wire 1 and an outer wire 2. The pulp suspension is fed in between the forming wire 1 and the outer wire 2 through nozzles by a headbox 5 and led around a forming roll 6, which may contain suction elements, whereby a paper web 3 forms. This paper web 3 is led over at least one, preferably several, vacuum boxes 7, which can also be arranged opposite deflection rolls 8. Subsequently, paper web 3 is taken over by a dryer fabric 4 using a web removal box 9 or a web removal roll. From the dryer fabric 4 the web is fed to the dryer, especially through dryer.

Figure 2:
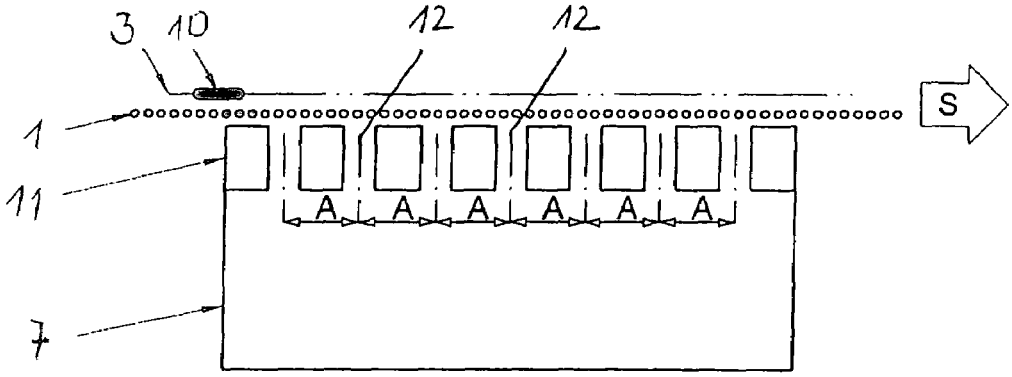
FIG. 2 shows a vacuum box according to an aspect of the invention.

FIG. 2 shows a very small unit area e.g., (particle) 10 of the paper web 3 being moved over a perforated plate 11 together with the forming wire 1. Thus, the vacuum applied at the vacuum box 7 acts on particle 10 pulsatingly. From pitch A [m] of the holes 12 and the machine speed S [m/s], the pulse frequency f [Hz] can be calculated using the following formula:

$$f=S/A.$$

The holes 12 of the perforated plate 11 can be of circular, oblong, or elliptic shape.

An increase of approx. 25% to approx. 28% of the dryness of a web has been achieved with an arrangement according to the invention and with the same open hole area as the conventional perforations of a suction box and identical suction volume.

Figure 3:
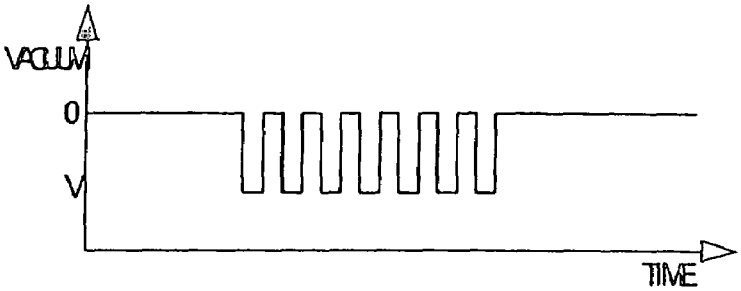
FIG. 3 shows the course of the vacuum for a particle of the paper web.

FIG. 3 shows the course of the vacuum acting on a particle of the paper web as a function of time. The value V may amount to between 150 and 900 mbar especially between 300 and 700 mbar.

Figure 4:
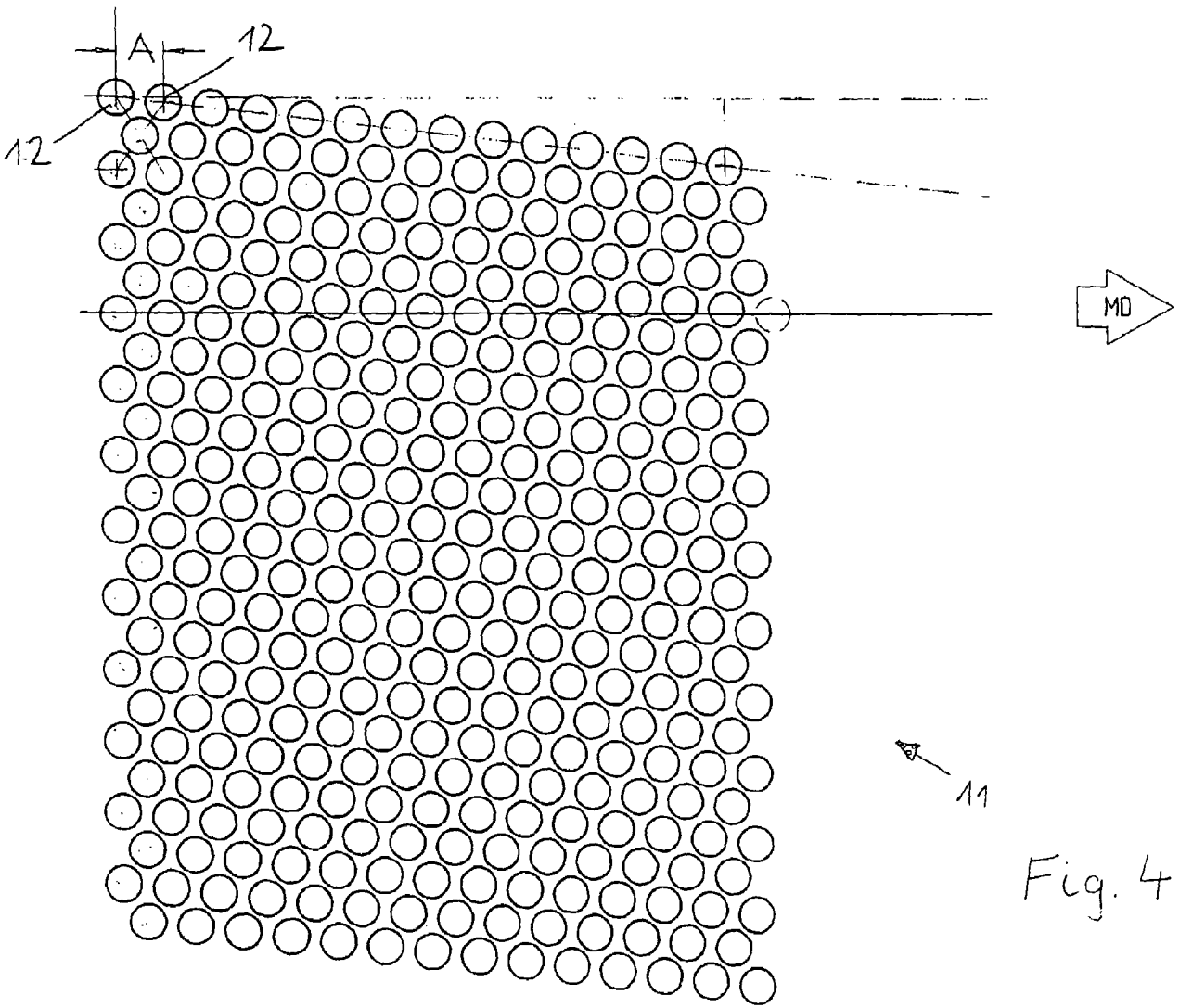
FIG. 4 is a top view of a perforated plate according to an embodiment of the invention.

FIG. 4 shows a top view of a perforated plate 11 according to the invention, where the holes 12 have pitch A in the direction of the web run (machine direction, MD). It can also be seen that the holes 12 of successive rows in crosswise direction to the web run (machine direction) overlap and thus no strip remains that is not subjected to the vacuum.

The invention claimed is:

1. In a process for dewatering a web of fiber particles on a forming wire, by applying a vacuum through the forming wire to the web, the improvement comprising moving the web and forming wire over a stationary, perforated plate of a vacuum device and applying a vacuum through the plate and forming wire, wherein the forming wire is subjected to vacuum pulses between a maximum value and a minimum value such that each particle of the web is subjected to vacuum pulsations during movement of the forming wire and web over the perforated plate.

2. Process according to claim 1, wherein the web moves in a machine direction and between 3 to 100 pulses are applied to each particle of the moving web.

3. Process according to claim 2, wherein the perforations are spaced apart by a pitch dimension, the forming wire and web travel over the perforations at a machine speed such that the frequency of the pulsations is between 1,500 and 10,000 Hertz.

4. Process according to claim 1, wherein the maximum value (V) of the vacuum is between 150 and 900 mbar.

5. Process according to claim 4, wherein the maximum value (V) of the vacuum is between 500 and 700 mbar.

6. Process according to claim 1, wherein the minimum value of the vacuum is 0 mbar.

7. Process according to claim 1, wherein two distinct vacuum devices dewater the web successively.

8. Process according to claim 1, wherein the web is a paper web.

9. Process according to claim 8, wherein the web moves in a machine direction over the vacuum device and between 25 and 100 pulses are applied to each particle of the moving web by said device.

10. Process according to claim 8, wherein the maximum value (V) of the vacuum is between 150 and 900 mbar.

11. Process according to claim 10, wherein the web moves in a machine direction over the vacuum device and between 25 and 100 pulses are applied to each particle of the moving web by said device.

12. Process according to claim 8, wherein the minimum value of the vacuum is 0 mbar.

13. Process according to claim 8, wherein two distinct vacuum devices dewater the web successively.

* * * * *